US005975092A

United States Patent [19]

Tsai

[11] Patent Number: 5,975,092

[45] Date of Patent: Nov. 2, 1999

[54] WAVE CLIP AND ORNAMENT ARRANGEMENT

[76] Inventor: Kai-Mou Tsai, 4/F., No. 1, Lane 135, Tao-Hsiang Rd., Peitou Dist., Taipei City, Taiwan

[21] Appl. No.: 09/294,318

[22] Filed: Apr. 20, 1999

[51] Int. Cl.[6] ..... A45D 8/12; A45D 8/04; A45D 8/00; A45D 8/20

[52] U.S. Cl. ..... 132/275; 132/273; 132/276; 132/277

[58] Field of Search ..... 132/275, 273, 132/274, 276, 277, 278, 279

[56] References Cited

U.S. PATENT DOCUMENTS

| | | | |
|---|---|---|---|
| 4,896,685 | 1/1990 | Lawrence | 132/278 |
| 5,303,724 | 4/1994 | Anzivino | 132/275 |
| 5,697,387 | 12/1997 | Hanisco | 132/275 |
| 5,735,295 | 4/1998 | Sammon | 132/275 |

FOREIGN PATENT DOCUMENTS

| | | | |
|---|---|---|---|
| 2672192 | 8/1992 | France | 132/275 |

*Primary Examiner*—John J. Wilson
*Assistant Examiner*—Robyn Doan
*Attorney, Agent, or Firm*—Rosenberg, Klein & Lee

[57] ABSTRACT

A wave clip and ornament arrangement, which includes a wave clip for fastening the hair, and an ornament fastened to the wave clip for decoration, wherein the ornament has a bottom cloth layer, an elongated insertion slot at the cloth layer on the middle, and two elongated locating holes provided at the cloth layer and equally spaced from the elongated insertion slot at two opposite sides; the wave clip has two operating handles respectively inserted into the elongated insertion slot at the cloth layer of the ornament and fastened to the cloth layer of the ornament at two opposite sides of the elongated insertion slot, the handles each having an integral hook respectively hooked in the elongated locating holes at the cloth layer of the ornament.

4 Claims, 8 Drawing Sheets

WAVE CLIP AND ORNAMENT ARRANGEMENT

BACKGROUND OF THE INVENTION

The present invention relates to a wave clip for fastening the hair, and more specifically to a wave clip and ornament arrangement in which the wave clip is decorated with a detachable ornament.

A variety of hair clips and wave clips have been disclosed, and have appeared on the market. Regular wave clips may be decorated with an ornament to attract consumers. The ornament of a regular wave clip is not detachable. A consumer may have to prepare a big number of wave clips of different designs for use to fit different dresses.

SUMMARY OF THE INVENTION

The present invention provides a wave clip and ornament arrangement which allows the user to conveniently quickly detach the ornament from the wave clip for a replacement. According to one embodiment of the present invention, the ornament has a bottom cloth layer, an elongated insertion slot at the cloth layer on the middle, and two elongated locating holes provided at the cloth layer and equally spaced from the elongated insertion slot at two opposite sides. The wave clip has two hooks respectively formed integral with its two operating handles for securing the handles to the bottom cloth layer of the ornament. The ornament is fastened to the wave clip by: inserting the handles into the elongated insertion slot at the ornament, and then respectively hooking the hook at each of the handles in the locating holes at the bottom cloth layer of the ornament.

DETAILED DESCRIPTION OF THE PREFERRED EMBODIMENT

Figure 1:
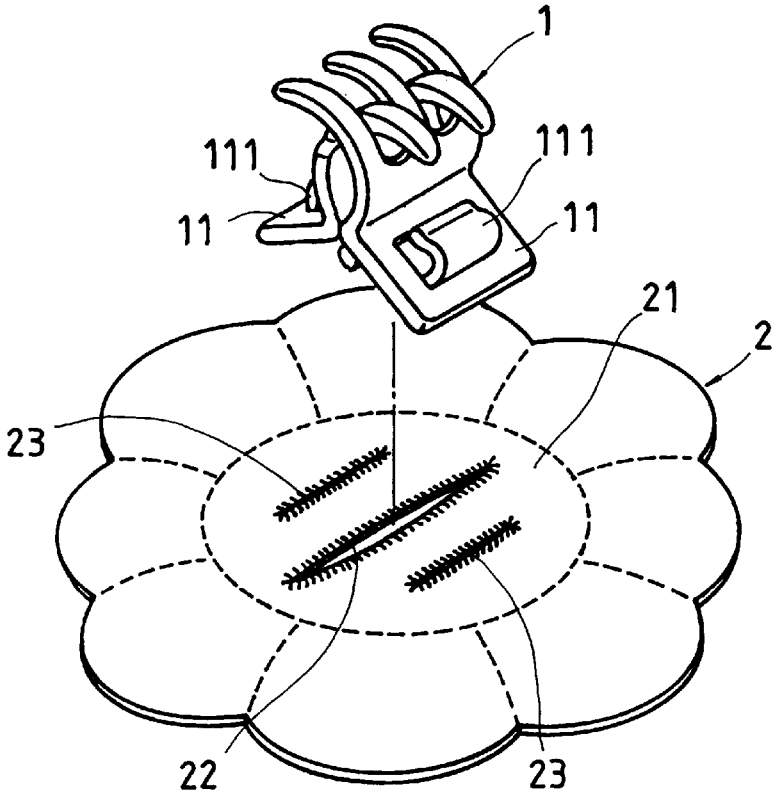
FIG. 1 is an exploded view of a first embodiment of the present invention.
Figure 2:
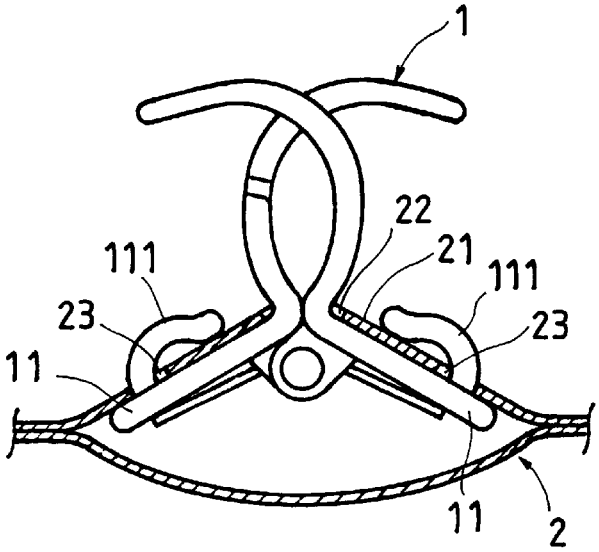
FIG. 2 is a sectional assembly view of the first embodiment shown in FIG. 1.
Figure 3:
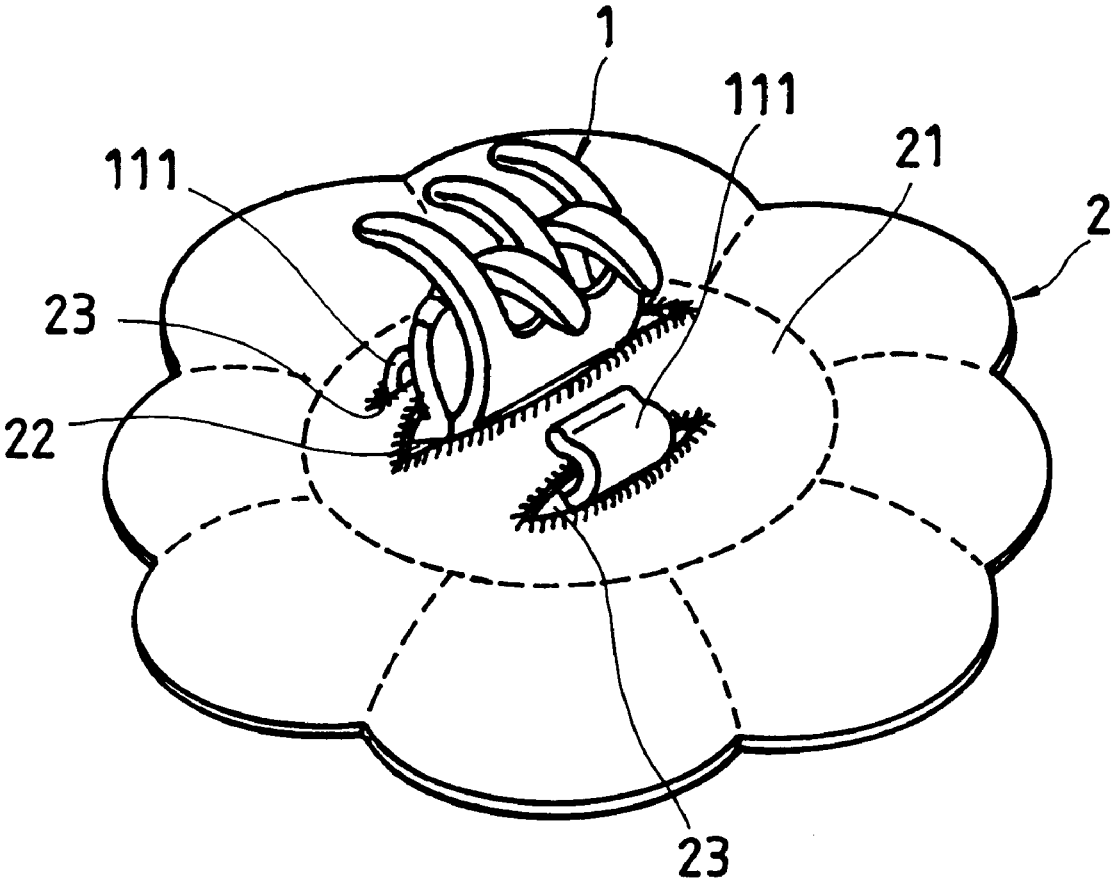
FIG. 3 is a perspective view of the first embodiment shown in FIG. 2.

Referring to Figures from 1 through 3, a wave clip and ornament arrangement according to a first embodiment of the present invention is shown comprised of a wave clip 1, and an ornament 2. The wave clip 1 comprises two handles 11 hinged together. The handles 11 each comprise a hook 111. The ornament 2 is shaped like, for example, a flower, having a bottom cloth layer 21, an elongated insertion slot 22 provided at the cloth layer 21 on the middle, and two elongated locating holes 23 provided at the cloth layer 21 and equally spaced from the elongated insertion slot 22 at two opposite sides. By forcing the handles 11 toward each other, the hair clip is opened. When the user releases the hands from the handles 11, the wave clip 1 is forced by spring means (not shown) thereof from the open position to the close position. The handles 11 of the wave clip 1 are inserted through the elongated insertion slot 22, and then secured to the cloth layer 21 by hooking the hooks 111 at the handles 11 in the elongated locating holes 23 at the cloth layer 21.

Figure 4:
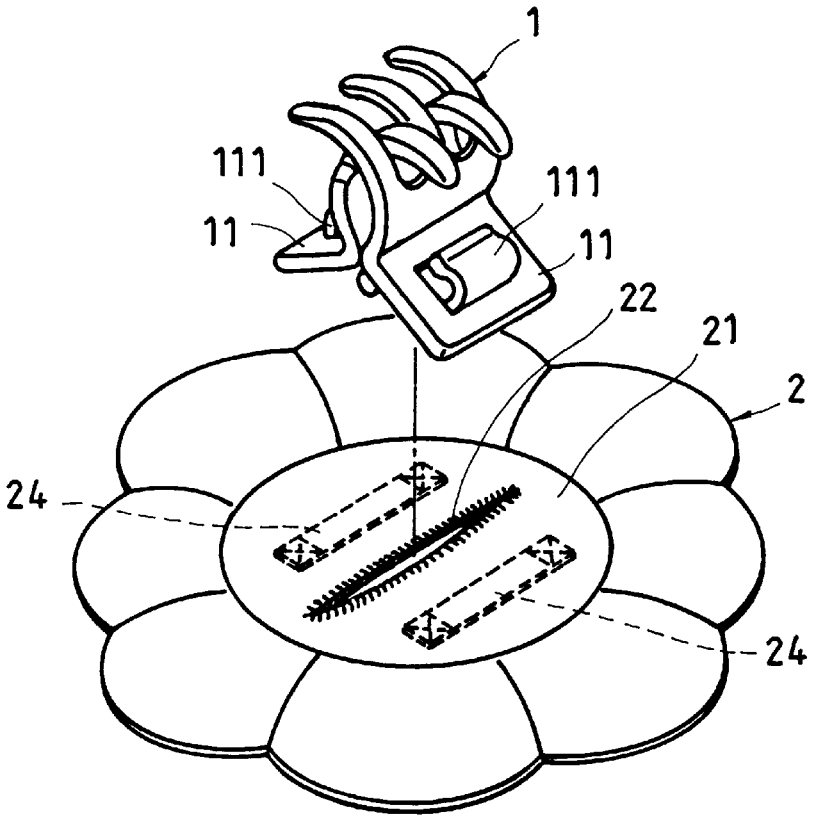
FIG. 4 is an exploded view of a second embodiment of the present invention.
Figure 5:
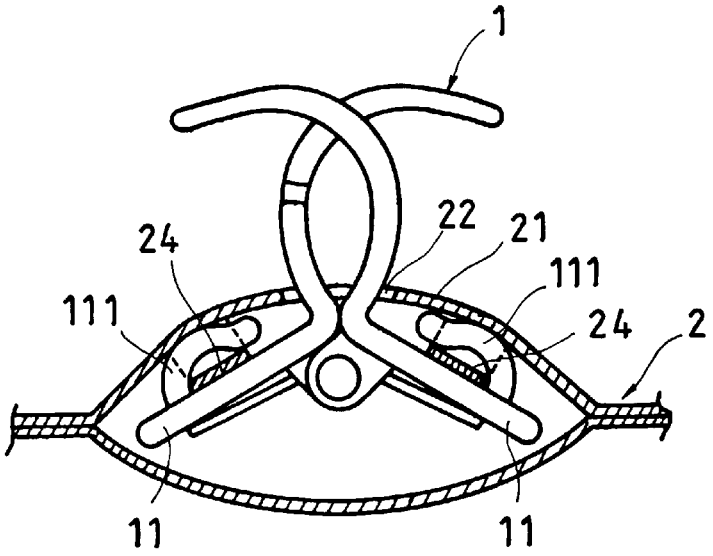
FIG. 5 is a sectional assembly view of the second embodiment shown in FIG. 4.

FIGS. 4 and 5 show a second embodiment of the present invention. According to this embodiment, the ornament 2 comprises a bottom cloth layer 21, an elongated insertion slot 22 provided at the cloth layer 21 on the middle, and two loops 24 fixedly provided at the inside wall of the cloth layer 21 and equally spaced from the elongated insertion slot 22 at two opposite sides. The wave clip 1 is same as that shown in Figures from 1 through 3. The handles 11 of the wave clip 1 are inserted through the elongated insertion slot 22, and then secured to the cloth layer 21 by hooking the hooks 111 at the handles 11 on the loops 24 inside the cloth layer 21.

Figure 6:
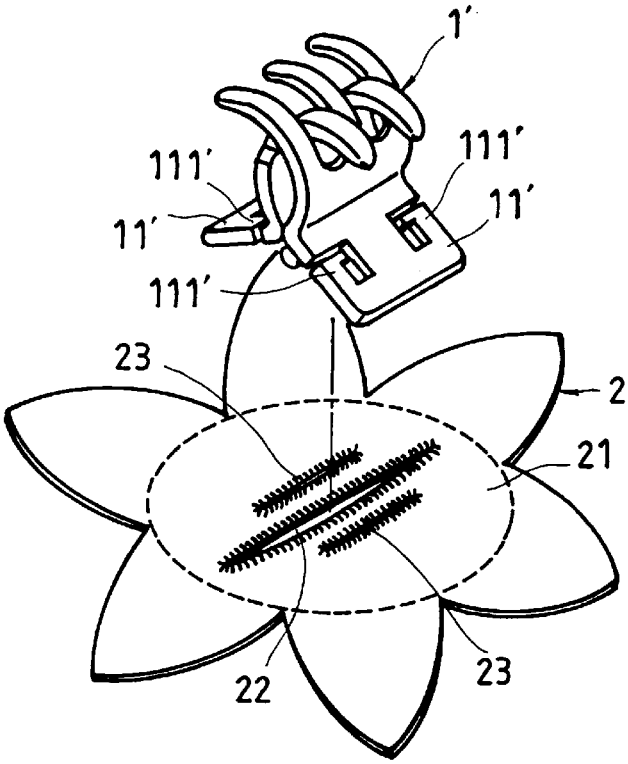
FIG. 6 an exploded view of a third embodiment of the present invention.
Figure 7:
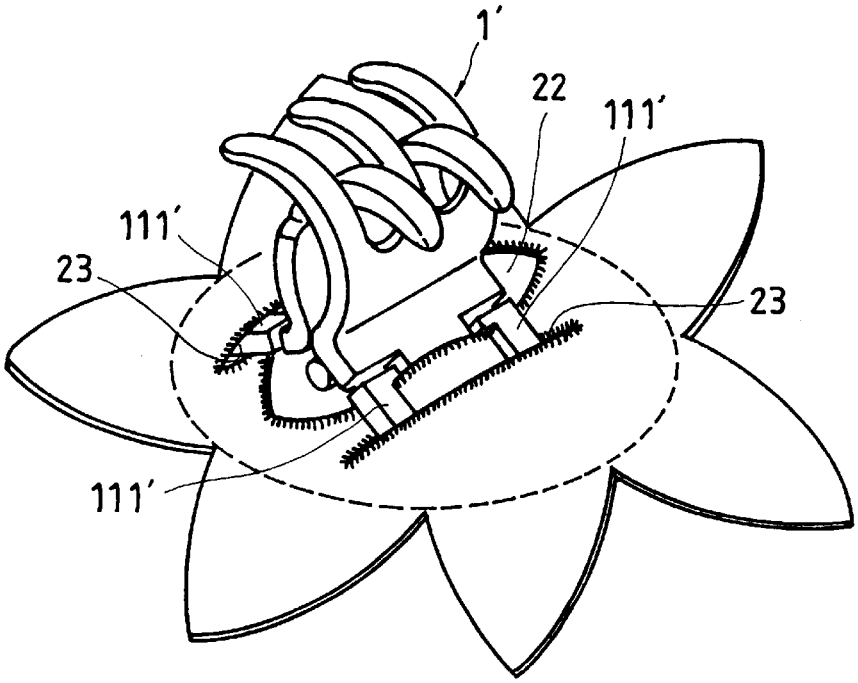
FIG. 7 is a sectional assembly view of the third embodiment shown in FIG. 6.

FIGS. 6 and 7 show a third embodiment of the present invention. According to this embodiment, two pairs of hooks 111' are respectively formed integral with the handles 11' of the wave clip 1'. The handles 11' of the wave clip 1' are inserted through the elongated insertion slot 22 at the cloth layer 21 of the ornament 2, and then secured to the cloth layer 21 by hooking the hooks 111' at the handles 11' in the locating holes 23 at the cloth layer 21 of the ornament 2.

Figure 8:
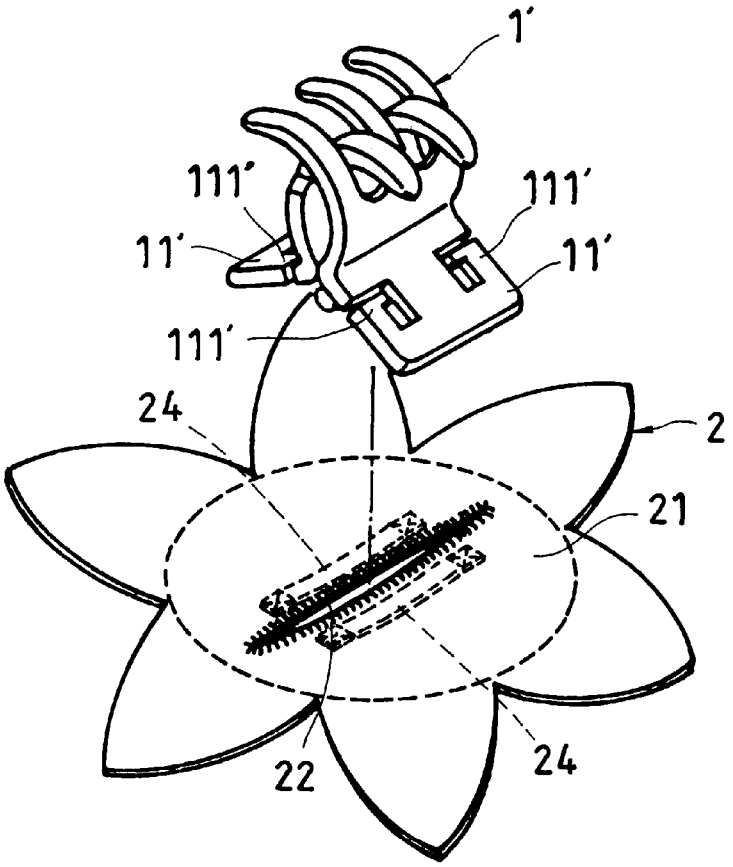
FIG. 8 an exploded view of a fourth embodiment of the present invention.
Figure 9:
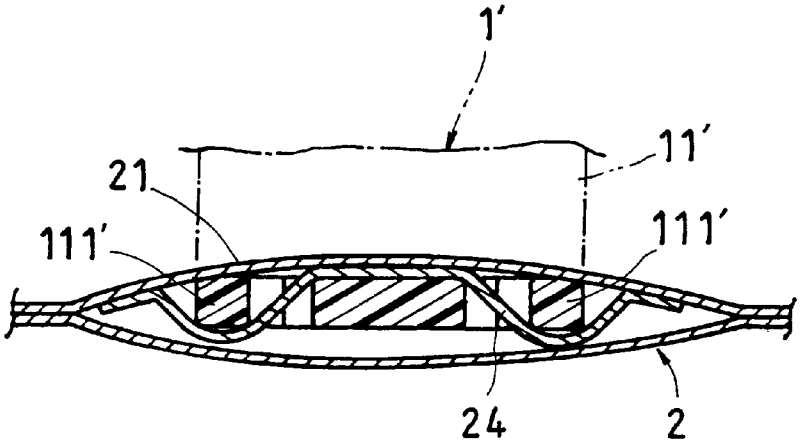
FIG. 9 is a sectional assembly view of the fourth embodiment shown in FIG. 8.

FIGS. 8 and 9 show a fourth embodiment of the present invention. According to this embodiment, the ornament 2 comprises a bottom cloth layer 21, an elongated insertion slot 22 provided at the cloth layer 21 on the middle, and two loops 24 fixedly provided at the inside wall of the cloth layer 21 and equally spaced from the elongated insertion slot 22 at two opposite sides. The wave clip 1' is same as that shown in FIGS. 6 and 7. The handles 11' of the wave clip 1' are inserted through the elongated insertion slot 22 at the cloth layer 21 of the ornament 2, and then secured to the cloth layer 21 by hooking the hooks 111' at the handles 11' on the loops 24 inside the cloth layer 21 of the ornament 2.

Figure 10:
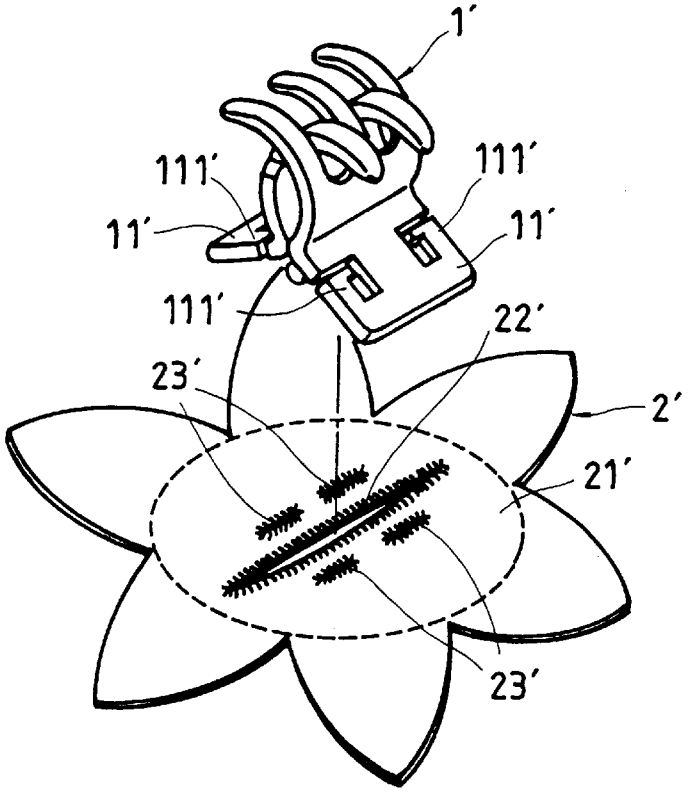
FIG. 10 an exploded view of a fifth embodiment of the present invention.
Figure 11:
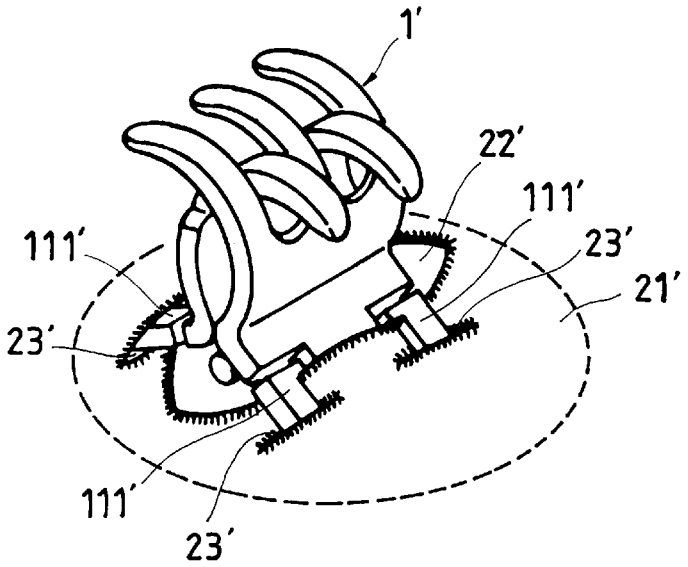
FIG. 11 is a sectional assembly view of the fifth embodiment shown in FIG. 10.
Figure 13:
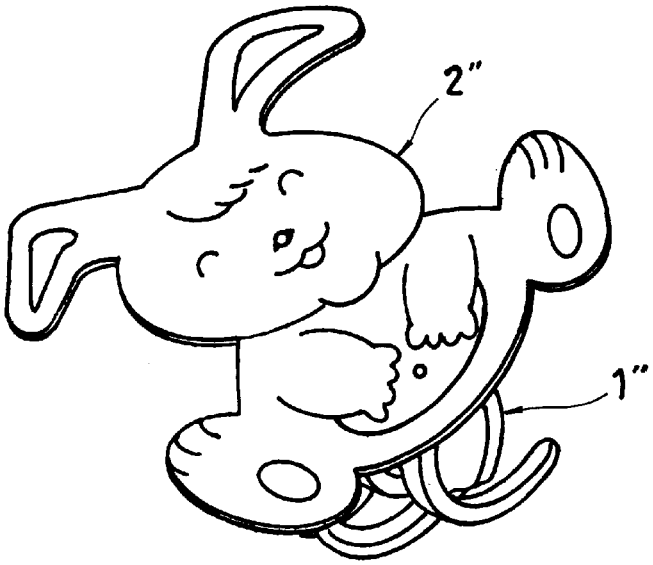
FIG. 13 a perspective view of the sixth embodiment shown in FIG. 12.
Figure 12:
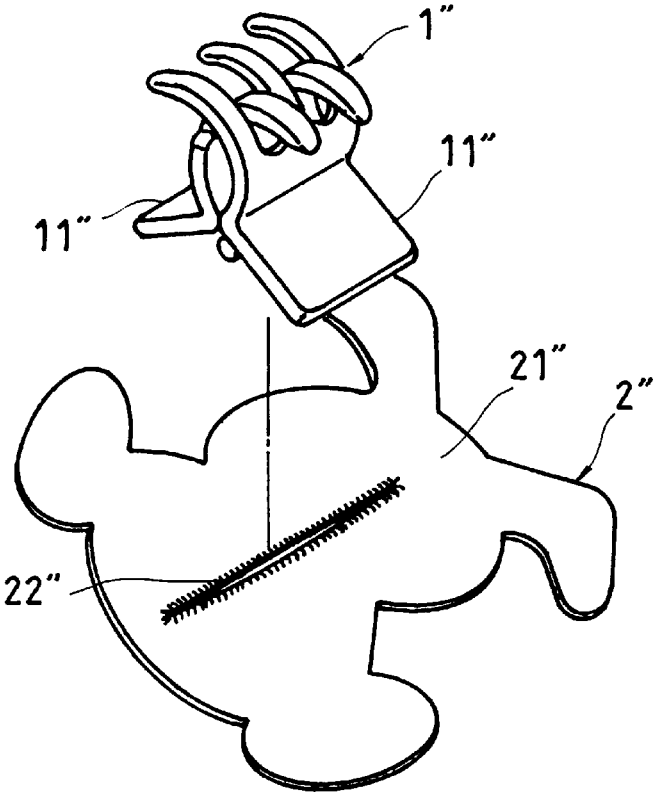
FIG. 12 is an exploded view of a sixth embodiment of the present invention.
Figure 14:
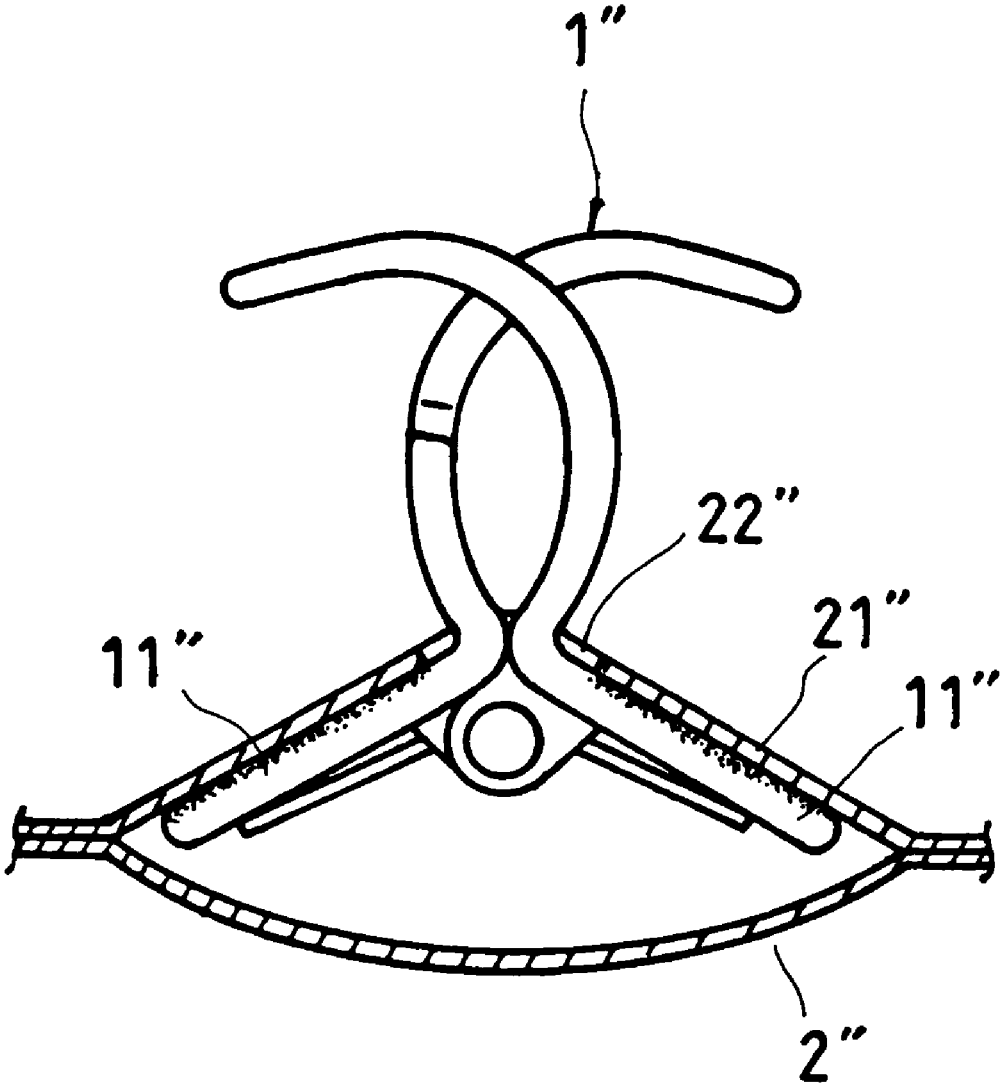
FIG. 14 is a sectional assembly view of the sixth embodiment according to the present invention.

FIGS. 10 and 11 show a fifth embodiment of the present invention. According to this embodiment, the ornament 2' comprises a bottom cloth layer 21', an elongated insertion slot 22' provided at the cloth layer 21' on the middle, and two symmetrical pairs of locating holes 23' provided at the cloth layer 21' and spaced from the elongated insertion slot 22' at two opposite sides. The wave clip 1' is same as that shown in Figures from 6 through 9. The handles 11' of the wave clip 1' are inserted through the elongated insertion slot 22' at the cloth layer 21' of the ornament 2', and then secured to the cloth layer 21' by hooking the hooks 111' at the handles 11' in the locating holes 23' at the cloth layer 21' of the ornament 2'.

Figures from 12 through 14 show a sixth embodiment of the present invention. According to this embodiment, the ornament 2" comprises a bottom cloth layer 21", and an elongated insertion slot 22" provided at the cloth layer 21" on the middle, and the handles 11" of the wave clip 1" are respectively inserted through the elongated insertion slot 22" at the cloth layer 21" of the ornament 2", and then adhered to the inside wall of the cloth layer 21" at two opposite sides of the elongated insertion slot 22".

It is to be understood that the drawings arc designed for purposes of illustration only, and are not intended for use as a definition of the limits and scope of the invention disclosed.

What the invention claimed is:

1. A wave clip and ornament arrangement comprising a wave clip for fastening the hair, said wave clip comprising two hinged handles for operation by hand to open said wave clip, and an ornament fastened to said wave clip for decoration, wherein said ornament comprises a bottom cloth layer, an elongated insertion slot provided at said cloth layer on the middle, and at least two elongated locating holes provided at said cloth layer and equally spaced from said elongated insertion slot at two opposite sides; the handles of said wave clip are inserted into the elongated insertion slot at the cloth layer of said ornament and fastened to the cloth layer of said ornament at two opposite sides of said elongated insertion slot, said handles each comprising at least one hook respectively hooked in the elongated locating holes at said cloth layer of said ornament.

2. A wave clip and ornament arrangement comprising a wave clip for fastening the hair, said wave clip comprising two hinged handles for operation by hand to open said wave clip, and an ornament fastened to said wave clip for decoration, wherein said ornament comprises a bottom cloth layer, an elongated insertion slot provided at said cloth layer on the middle, and two loops fixedly provided at said cloth layer inside said ornament and equally spaced from said elongated insertion slot at two opposite sides; the handles of said wave clip are inserted into the elongated insertion slot at the cloth layer of said ornament and fastened to the cloth layer of said ornament at two opposite sides of said elongated insertion slot, said handles each comprising at least one hook respectively hooked on the loops inside said ornament.

3. The clip and ornament arrangement of claim 1 wherein said handles of said wave clip each comprise two hooks respectively hooked in the at least two elongated locating holes at two opposite sides of said elongated insertion slot at said cloth layer of said ornament.

4. A wave clip and ornament arrangement comprising a wave clip for fastening the hair, said wave clip comprising two hinged handles for operation by hand to open said wave clip, and an ornament fastened to said wave clip for decoration, wherein said ornament comprises a bottom cloth layer, and an elongated insertion slot provided at said cloth layer on the middle; the handles of said wave clip are inserted into the elongated insertion slot at the cloth layer of said ornament and fastened to said cloth layer inside said ornament at two opposite sides of said elongated insertion slot by an adhesive.

* * * * *